US005749644A

United States Patent [19]

Carbone

[11] Patent Number: 5,749,644

[45] Date of Patent: May 12, 1998

[54] FLEXIBLE ELECTRICAL DEVICE WITH ATTACHABLE ENDS

[75] Inventor: Richard C. Carbone, Southbury, Conn.

[73] Assignee: Black & Decker Inc., Newark, Del.

[21] Appl. No.: 738,741

[22] Filed: Oct. 28, 1996

[51] Int. Cl.[6] ..... F21L 15/20

[52] U.S. Cl. ..... 362/198; 362/194; 362/285; 362/418

[58] Field of Search ..... 362/190, 191, 362/194, 196–200, 202, 205, 206, 208, 285, 389, 418, 419

[56] References Cited

U.S. PATENT DOCUMENTS

| | | | |
|---|---|---|---|
| 642,648 | 2/1900 | Van Duzer | 362/198 |
| 2,071,557 | 2/1937 | Miyaoka | 362/198 |
| 2,320,917 | 6/1943 | Ely | 362/194 |
| 2,550,423 | 4/1951 | Nelson | 362/198 |
| 3,393,311 | 7/1968 | Dahl | 362/198 |
| 3,393,312 | 7/1968 | Dahl | 362/198 |
| 5,514,483 | 5/1996 | Zeller | 362/198 |
| 5,517,392 | 5/1996 | Rousso et al. | 362/198 |
| 5,521,803 | 5/1996 | Eckert et al. | 362/198 |
| 5,567,115 | 10/1996 | Eckert et al. | 362/198 |

*Primary Examiner*—Alan Cariaso
*Attorney, Agent, or Firm*—Barry E. Deutsch

[57] ABSTRACT

A flashlight having a flexible core, a power supply end connected to one end of the flexible core and an illumination end connected to an opposite end of the flexible core. The power supply end has a recess on its exterior. The illumination end has a projection on its exterior. The two ends can be removably connected to each other with the projection being received in the recess. In a preferred embodiment, the projection is a resilient ring extending around a perimeter of the housing on the illumination end.

14 Claims, 1 Drawing Sheet

FLEXIBLE ELECTRICAL DEVICE WITH ATTACHABLE ENDS

BACKGROUND OF THE INVENTION

1. Field of the Invention

The present invention relates to electrical devices and, more particularly, to a flexible device with two ends that can be removably connected to each other.

2. Prior Art

U.S. Pat. Nos. 5,517,392; 5,521,803; and 5,567,115 disclose a flashlight with a flexible core and two ends that can be removably connected to each other. U.S. Pat. No. 5,154,483 discloses a flexible flashlight with a housing having a retainer for the illumination end.

SUMMARY OF THE INVENTION

In accordance with one embodiment of the present invention, a flashlight is provided having a flexible core, a power supply end connected to a first end of the flexible core, and an illumination end connected to an opposite second end of the flexible core. The improvement comprises the power supply end having a recess on its exterior and the illumination end having a projection extending from its exterior surface. The projection is adapted to be inserted into the recess and thereby directly mechanically connect the power supply end to the illumination end.

In accordance with another embodiment of the present invention, a flashlight is provided comprising a flexible core, a first end section, a second end section, and means for connecting the first and second end sections directly on to each other. The first end section is connected to a first end of the flexible core. The second end section is connected to an opposite second end of the flexible core. The means for connecting includes a circumferential projecting ridge on one of the end sections and a corresponding receiving area on the other end section.

In accordance with another embodiment of the present invention, an electrical device is provided having a flexible core, a first housing section connected to a first end of the flexible core, and a second housing section connected to a second end of the flexible core. The improvement comprises the second housing section having a ring-shaped projection thereon for attaching the first housing section to the second housing section.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
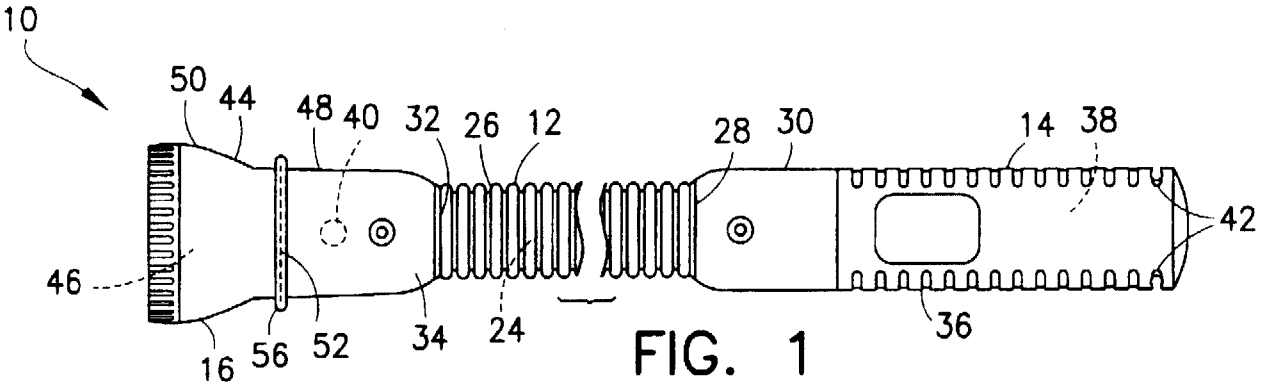
FIG. 1 is an elevational side view of a flashlight incorporating features of the present invention.

Referring to FIG. 1, there is shown a flashlight 10 incorporating features of the present invention. Although the present invention will be described with reference to the single embodiment shown in the drawings, it should be understood that the present invention can be embodied in many different forms of alternate embodiments. The present invention can be used in other types of flashlights and in other types of suitable electrical devices. In addition, any suitable size, shape or type of elements or materials could be used.

The flashlight 10 generally comprises a flexible core 12, a power supply end 14 and an illumination end 16. The flexible core 12, in the embodiment shown, comprises an inner flexible spine 24 and an outer resilient sleeve 26. The spine 24 is comprised of a plurality of interconnected universally rotatable members. The core 12 is substantially the same as the flexible core described in U.S. Pat. Nos. 5,517,392; 5,521,803; and 5,567,115 which are hereby incorporated by reference in their entirety. In alternate embodiments, other types of flexible cores could be used. A rear end 28 of the flexible core 12 is connected to a front end 30 of the power supply end 14. The front end 32 of the core 12 is connected to a rear end 34 of the illumination head 16.

Figure 3:
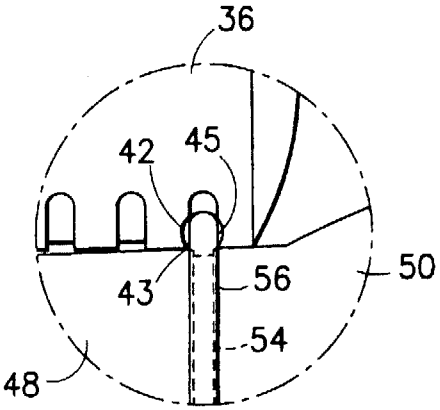
FIG. 3 is an enlarged view of area 3 shown in FIG. 2.

The power supply end 14 has a housing 36 with a battery receiving area 38 therein. An electrical connector 40 could be alternatively or additionally provided on the housing 44 of the illumination end 16 to allow the flashlight to be connected to an alternative power source. In the embodiment shown, the rear end of the housing 36 has a receiving area on its exterior. The receiving area comprises two grooves 42. The grooves 42 are located on opposite sides of the housing 36. Each groove 42 has a narrowed entrance opening 43 and a wider interior area 45 (see FIG. 3). The two grooves 42 extend generally transverse to a longitudinal axis of the power supply end. In alternate embodiments, more or less than two grooves could be provided. In addition, a single groove that extended around the entire outer perimeter of the housing 36 could also be provided. The illumination end 16 includes a housing 44 and a light source 46, such as a light bulb, located inside the housing 44. In the embodiment shown, the housing 44 is comprised of an adapter member 48 and a lamp housing member 50. The adapter member 48 is connected to the front end 32 of the flexible core 12 and the lamp housing member 50 is connected to the front of the adapter member 48. In alternate embodiments, the housing 44 could be comprised of more or less than two housing members. Located at a junction 52 of the two housing members 48, 50 is a groove 54 (see FIG. 3). The groove 54 extends around the entire perimeter of the housing 44 at the junction 52. Located in the groove 54 is a ring-shaped member 56. The ring 56 is preferably made of resilient material in the form of an O-ring. However, the ring 56 could have other shapes and include other materials. The ring 56 is mounted to the housing 44 due to its positioning in the groove 54. In alternate embodiments, other types of means could be used to mount the ring to the illumination end housing. The groove 54 need not be formed at a junction of two members. The groove and ring could also be located at the junction of a lens ring to the lamp housing or any other suitable location on the illumination end housing. The ring 56 forms a projection or projecting ridge along the circumference of the housing 44 at the groove. In another alternate embodiment, the projecting ridge could be formed integral with the illumination end housing. In addition, any suitable type of projection or projections from the illumination end could be provided.

Figure 2:
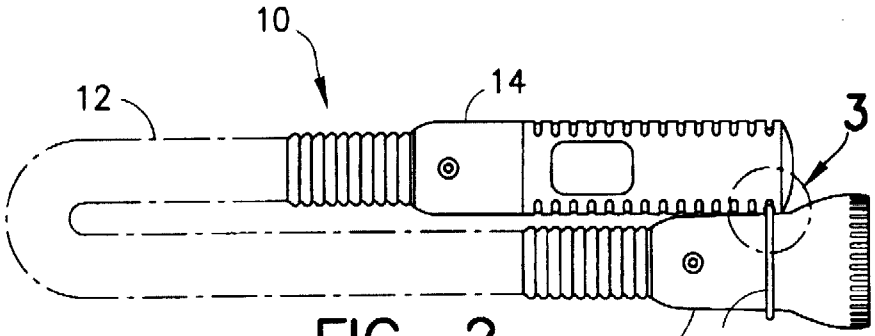
FIG. 2 is an elevational side view of the flashlight shown in FIG. 1 with its two ends connected to each other.

Referring also to FIG. 2, the flashlight 10 is shown in a configuration with its two ends 14, 16 connected to each other. As noted above, the core 12 is flexible. Thus, the core 12 can be bent to position the two ends 14, 16 next to each other. The two ends 14, 16 are connected to each other at area 3 which is shown enlarged in FIG. 3. The ring 56 has been inserted into the groove 42. The entrance opening 43 of the groove 42 is narrower than the width of the ring 56. The ring 56 is resiliently deformed when it is passed through the entrance opening 43. However, it substantially resumes its natural shape in the wider interior area 45. The connection system also provides a snap-mounting of the two end 14, 16 to each other. More specifically, when the ring 56 is being inserted into the groove 42, as the ring 56 returns towards its natural undeformed state, it pushes against the inside of the groove 42 at the entrance opening 43. This snap-mounts the two ends 14, 16 together. However, in an alternate embodiment, the interaction between the ring and the groove could be merely frictional.

In order to disconnect the two ends 14, 16 from each other, the portion of the ring 56 inside the groove 42 must be deformed to pass through the narrowed entrance opening 43. This helps to prevent inadvertent disconnection of the two ends 14, 16 from each other. However, a user can rather easily intentionally disconnect the two ends from each other by applying sufficient force. A user could also use leverage by canting the end 14 relative to the end 16. Alternatively, additional connection means could be provided and/or alternative projection and recess interactions between the two ends could be provided. The ridge could also be located on the power supply end and the receiving area would then be located on the illumination end.

It should be understood that the foregoing description is only illustrative of the invention. Various alternatives and modifications can be devised by those skilled in the art without departing from the scope of the invention. Accordingly, the present invention is intended to embrace all such alternatives, modifications and variances which fall within the scope of the appended claims.

What is claimed is:

1. In a flashlight having a flexible core, a power supply end connected to a first end of the flexible core, and an illumination end connected to an opposite second end of the flexible core, wherein the improvement comprises:

the power supply end having a recess on its exterior and the illumination end having a projection extending from its exterior surface, wherein the projection is adapted to be inserted into the recess and thereby mechanically connect the power supply end to the illumination end said projection comprising a resilient O-ring.

2. A flashlight as in claim 1 wherein the power supply end has two recesses, each recess being located on an opposite side of a housing of the power supply end.

3. A flashlight as in claim 1 wherein the projection extends circumferentially around a housing of the illumination end.

4. A flashlight as in claim 3 wherein the housing of the illumination end has a groove in which the resilient O-ring is mounted.

5. A flashlight as in claim 4 wherein the housing includes two abutting members, with the groove being formed at a junction of said two housing members.

6. A flashlight as in claim 1 wherein the recess is a groove and the projection deformingly snap-mounts into the groove.

7. A flashlight comprising:

a. flexible core;

a first end section connected to a first end of the flexible core;

a second end section connected to an opposite second end of the flexible core; and means for connecting the first and second end sections directly onto each other, the means for connecting including a circumferentially projecting ridge on one of the end sections and a corresponding receiving area on the other end section, said projecting ridge comprising a resilient O-ring.

8. A flashlight as in claim 7 wherein a housing of the second end section has a groove in which the resilient O-ring is mounted.

9. A flashlight as in claim 8 wherein the housing includes two abutting members, with the groove being formed at a junction of said two housing members.

10. A flashlight as in claim 7 wherein the receiving area is a groove on the first end section that is generally transverse to a longitudinal axis of the first end section and the ridge deformingly snap-mounts into the groove.

11. A flashlight as in claim 7 wherein the receiving area includes sections on opposite sides of the first end section.

12. In an electrical device having a flexible core, a first housing section connected to a first end of the flexible core, a second housing section connected to a second end of the flexible core, wherein the improvement comprises:

the second housing section having a general ring shaped projection thereon, and said first housing section including a groove in which the ring shaped projection is mounted for attaching the first housing section to the second housing section, the ring shaped projection is a resilient O-ring mounted on the second housing section.

13. An electrical device as in claim 12 wherein the ring shaped projection extends around an entire outer perimeter of the second housing section.

14. A flashlight as in claim 13 wherein the first housing section includes two abutting members, with a groove being formed at the junction between said two abutting members.

* * * * *